US009439472B2

(12) United States Patent
Aronson

(10) Patent No.: US 9,439,472 B2
(45) Date of Patent: Sep. 13, 2016

(54) COMFORT HEADGEAR WITH MOISTURE-DRAINING AND ABSORPTION MECHANISM

(71) Applicant: 4Headwear, LLC, Louisville, KY (US)

(72) Inventor: Steven Aronson, Louisville, KY (US)

(73) Assignee: 4HEADWEAR, LLC, Louisville, KY (US)

( * ) Notice: Subject to any disclaimer, the term of this patent is extended or adjusted under 35 U.S.C. 154(b) by 0 days.

(21) Appl. No.: 14/744,853

(22) Filed: Jun. 19, 2015

(65) Prior Publication Data

US 2015/0282551 A1 Oct. 8, 2015

Related U.S. Application Data

(63) Continuation of application No. 13/239,047, filed on Sep. 21, 2011, now Pat. No. 9,095,183.

(60) Provisional application No. 61/385,003, filed on Sep. 21, 2010.

(51) Int. Cl.

| | |
|---|---|
| ***A42B 1/04*** | (2006.01) |
| ***A42C 5/02*** | (2006.01) |
| ***A42C 5/04*** | (2006.01) |
| ***A42B 1/06*** | (2006.01) |

(52) U.S. Cl.

CPC ..... *A42C 5/02* (2013.01); *A42B 1/062* (2013.01); *A42C 5/04* (2013.01)

(58) Field of Classification Search

CPC ..... A42C 5/02; A42C 5/04; A42B 1/062
See application file for complete search history.

(56) References Cited

U.S. PATENT DOCUMENTS

| | | | | | |
|---|---|---|---|---|---|
| 554,600 | A | * | 2/1896 | Hirschberg | A42B 1/14 2/182.5 |
| 563,175 | A | * | 6/1896 | Seiteman | A42C 5/04 2/171.6 |
| 899,334 | A | * | 9/1908 | Sands | A42B 1/247 2/10 |
| 946,770 | A | * | 1/1910 | Bartholomew | A42B 1/12 2/172 |
| D58,303 | S | * | 7/1921 | Peters | D2/865 |
| 1,589,614 | A | * | 6/1926 | Peters | A42B 1/041 2/171.01 |
| 2,445,209 | A | * | 7/1948 | Clark | A42C 5/02 2/181 |
| 3,128,474 | A | * | 4/1964 | Feldman | A42B 1/062 2/12 |

(Continued)

OTHER PUBLICATIONS

Hats for Bald Guys, http://hatsforbaldguys.com/, p. 1, website created Mar. 22, 2010.

(Continued)

*Primary Examiner* — Richale Quinn
(74) *Attorney, Agent, or Firm* — Middleton Reutlinger

(57) ABSTRACT

This application relates to a headgear that provides a moisture wicking mechanism. In various embodiments, a headgear may include a crown with a top, a bottom, a front, a rear, and two sides. In various embodiments, the top, front, rear and two sides may enclose an interior space, open at the bottom. In various embodiments, the bottom may include a perimeter, and the crown may include an outer surface and an inner surface, with the inner surface facing the interior space. In some embodiments, the crown may include multiple sections joined at seams, and the seams may form a convergence at the top of the crown. In some embodiments, a dome comprised of wicking material may at least partially cover the top of the crown, may have a wicking element comprised of wicking material, and may extend through the convergence of seams into the interior space of the crown.

20 Claims, 10 Drawing Sheets

(56) References Cited

U.S. PATENT DOCUMENTS 3,389,405 A * 6/1968 Fattori ..... A42B 3/145 2/418
4,101,981 A * 7/1978 Boden ..... A42C 5/04 2/171.3
4,550,445 A * 11/1985 Fender ..... A42C 5/04 2/181.6
4,815,144 A * 3/1989 Martin ..... A42C 5/04 2/171.2
4,856,116 A * 8/1989 Sullivan ..... A41D 20/00 2/12
5,105,476 A * 4/1992 Cox ..... A42B 1/064 2/12
5,125,113 A * 6/1992 Yun ..... A42B 1/205 2/10
5,181,277 A * 1/1993 Sherman ..... A42B 1/206 2/181
5,471,683 A * 12/1995 Moretz ..... A42C 5/02 2/169
5,566,395 A * 10/1996 Nebeker ..... A42C 5/02 2/181
5,572,745 A * 11/1996 Mainus ..... A41D 20/005 2/171.2
5,630,230 A * 5/1997 Fujino ..... A41D 20/005 2/200.1
5,659,896 A * 8/1997 Taylor ..... A61F 9/045 2/12
5,887,289 A * 3/1999 Theoret ..... A42B 1/08 2/195.1
5,956,773 A * 9/1999 LaMantia ..... A42B 1/062 2/181
6,012,172 A * 1/2000 Steffy ..... A42B 1/02 2/175.1
6,367,084 B1 * 4/2002 Keast ..... A42C 5/04 2/182.7
6,408,443 B1 * 6/2002 Park ..... A42B 1/248 2/195.1
6,634,030 B2 * 10/2003 Park ..... A42B 1/062 2/195.1
6,880,176 B2 * 4/2005 Timms ..... A42B 3/08 2/171.3
7,043,761 B2 * 5/2006 Epling ..... A42C 5/04 2/181
7,185,371 B2 * 3/2007 Koo ..... A42B 1/247 2/10
7,737,056 B2 * 6/2010 Chang ..... B32B 5/26 442/32
8,020,218 B2 * 9/2011 Stingone ..... A42B 1/065 2/175.1
8,393,014 B1 * 3/2013 Follo ..... A42C 5/02 2/181
8,402,564 B2 * 3/2013 Duwyn-Zylstra ..... A42B 1/22 2/175.1
2004/0231033 A1 * 11/2004 Cho ..... A42B 1/062 2/195.1
2005/0193470 A1 * 9/2005 Nalls ..... A42C 5/02 2/181
2005/0268382 A1 * 12/2005 Epling ..... A42C 5/04 2/411
2006/0005291 A1 * 1/2006 Bedford ..... A42C 5/04 2/7
2010/0107307 A1 * 5/2010 Lee ..... A42C 5/02 2/181
2010/0132094 A1 * 6/2010 Mullen ..... A42C 5/02 2/410

OTHER PUBLICATIONS

OMD Embroidery, http://omdembroidery.com/performancecaps.htm, pp. 1-3, website created Oct. 16, 2007.
Quality Logo Products, http://www.qualitylogoproducts.com/custom-hats/palm-springs-cap.htm, pp. 1-3, website created Jan. 26, 2011.
Sport-Smart.Com, http://www.sport-smart.com/Baseball-Hat-Type/Moisture-Wicking-Hats.aspx, pp. 1-2, website created Feb. 10, 2010.

* cited by examiner

COMFORT HEADGEAR WITH MOISTURE-DRAINING AND ABSORPTION MECHANISM

BACKGROUND OF THE INVENTION (a) Technical Field of the Invention

The present invention relates to any headgear, or an article of clothing to be worn on the head, especially a bald human head. Bald men perspire differently than men with hair and to date a hat has not been designed to address this issue.

Headgear, including hats and caps, are very popular among consumers. Consumers use these articles for protection against the sun, cold and rain, and as a clothing accessory. One important feature of these caps and hats is the ability to keep the head cool under the hot sun. Another important feature is a suitably designed interior that makes the cap comfortable to wear, and secures it to the head. Yet another desirable feature is to maintain the rigidity of the visor or front panel of a baseball or athletic cap.

Headgear is also popular and essential among sportspersons for the purpose of protecting the head. The risk of injury is a real and serious concern for athletes, especially those involved in contact or adventure sports. Thus, athletes have to wear protective headgear. However, by the very nature of the vigorous physical activity, athletes are prone to perspiration. There is a need for some mechanism to ventilate and cool the head, while protecting it adequately.

Baseball or athletic caps are especially popular among enthusiasts of outdoor sports. Many commercial designs are available that include features to keep the head ventilated and cooled. Given the outdoor use, many such caps are either made of ventilated netting material, or some suitable wicking fabric. However, these caps rely on the material and do not utilize structural features to channel and evaporate moisture.

Baseball or athletic caps and hats are very popular among men, including bald men. Bald heads do not have the hair to provide a buffer between the skin and the fabric of the cap. The lack of hair on bald heads also prevents the perspiration from being channeled through the strands of the hair. Therefore, a cap or hat on a bald head becomes filled with perspiration, is uncomfortable and does not wick moisture effectively unless it has some suitable linings on the interior, and a soft absorbent portion where the visor comes in contact with the forehead. A cap or hat on a sweaty bald head is even more uncomfortable unless the cap or hat is equipped with a systematic and efficient moisture wicking mechanism. Many existing designs for caps and hats lack proper moisture wicking and ventilation for bald heads. The resulting perspiration makes the fabric moist, leading to deformation of shape, sweat stains and discomfort to the bald head.

Many caps and hats are manufactured in very large quantities. Smaller quantities are subsequently purchased by retailers. Oftentimes, businesses or individuals might want these headgears personalized with an embroidered logo. A logo may be embroidered to the front portion of the cap by placing an embroidery hoop. Since this step is typically carried out after the headgear has been manufactured, the stitches on the reverse side of the logo would be sewn through the inner portion of the cap. These stitches would then come in contact with the skin of the wearer of the headgear, causing chafing. This chafing is exacerbated in bald individuals, who lack the protective layer of hair to cover their skin. There is therefore a need to overcome this problem by including a protective shield during the manufacture of the headgear, so that any logo, embroidery, lapel pin, badge, and such other objects may be added onto the exterior of the headgear at a point in time after the headgear is manufactured.

(b) Description of the Prior Art

Caps and hats that have been developed over the years may be classified into two groups: those that provide some features for comfort, or those that provide some features for moisture wicking. Pre-existing caps or hats do not adequately address the need for enhanced moisture wicking and comfort for bald men. Accordingly, there is a need to improve the caps, hats and headgear of the prior art.

In U.S. Pat. Pub. No. 2005/0235395, Tseng's invention relates to a cap having a visor with a soft and resilient inner edge that can be transformed to perfectly fit the wearer's forehead. However, while achieving a perfect fit for heads that have sufficient amount of hair, this invention becomes uncomfortable to the forehead of a bald person due to the added friction caused by the design of the resilient inner edge of the visor. The invention disclosed by Fender in U.S. Pat. No. 4,550,445 is that of a ventilated athletic cap. It has an adjustable sweatband, a semi-rigid visor and a canopy with air vents to permit air flow. Similarly, Ridley discloses an invention in U.S. Pat. No. 5,487,191 that has a vented visor cap designed to permit air flow and the unintentional removal of the cap by wind currents. However, neither has a mechanism to drain and evaporate the moisture from the head, nor do they have any comfort features, especially as relevant to the bald head.

A mechanism for absorbing moisture is disclosed by Duda et. al. in U.S. Pat. Pub. No. 2010/0138980. A baseball or athletic cap is designed that absorbs perspiration using a wicking material, and collects this moisture in a removable component attached to the visor in front. It lacks the ability to aid easy evaporation. Moreover, the extra moisture laden component in front adds weight, and additional discomfort to the area of the forehead.

In the area of athletic gear, U.S. Pat. Pub. No. 2007/0245451 by Desjardins and Tierney teaches us how to make a protective athletic glove with a ventilated palm portion. A wicking material draws the moisture from the inner palm surface to the outer surface of the glove. Since this invention relates to the hand, its drainage design and comfort parameters are very different from that of a headgear, especially like a trendy baseball or athletic cap.

A visor insert is disclosed by Gore in U.S. Pat. No. 6,138,279. While this maintains rigidity under high heat moisture and stress distortion, is prone to losing its shape when subjected to repeated machine washing.

Visors with some soft padding are also known in the prior art. Such soft portions are typically designed to provide a snug fit for the crown on the forehead. They are adequately padded to make them comfortable. Many headgears also come equipped with visors that have some wicking mechanism to absorb the sweat. However, none of these prior art headgears are effective in channeling the moisture away from the forehead. This is especially crucial for persons with a bald head. In such instances, there is a need for the visor to have an enhanced moisture wicking ability, while retaining their ability to provide a comfortable and snug fit.

It is common for headgears to be manufactured in bulk. Many of these headgears have logos embroidered on them. When embroidered caps are produced en masse, it is commercially viable to include the embroidery step as a part of the manufacturing process. In such instances, the headgear may come fitted with a flap that helps acts as a buffer between the embroidery stitches and the skin of the wearer of the headgear. Oftentimes though, when headgears are manufactured in bulk, they come without any embroidery or other designs. Typically, businesses or individuals approach retailers who carry these generic headgears, and require the headgears to be appropriately personalized. In particular, businesses or individuals may require a logo or some other embroidery to be placed onto the outer surface of the headgear, after the headgear has been manufactured. Many golf caps, for instance, are personalized after they are manufactured. When such a logo or embroidery is stitched onto the headgear, the stitches appear on the reverse side of the headgear. Given the costs of attaching an extra flap to buffer the stitches from the skin, most retailers skip this step.

The presence of the stitches on the reverse side of the embroidery may cause the skin to be irritated when it comes in contact with the stitches. This is especially true if the head lacks hair to act as a protective buffer. Thus, bald men would be more sensitive to chafing of the skin due to continuous friction between the skin and the stitches. This may be further exacerbated under hot or humid conditions. There is therefore a need for a protective shield to be placed at the time of manufacture of the headgear, without the headgear being personalized. Such a protective shield must be designed and placed in such a way so that embroidery may be added at any time after the manufacturing process is complete, and at any point in the stream of commerce. Moreover, if, as and when a logo is embroidered, the shield may then act as a protective buffer between the skin and the embroidery, without any additional modifications to the headgear. Therefore, this shield would be required to provide access to the region of the stitches so that an embroidery hoop or other such device may be inserted to embroider the selected portion of the headgear. Such a protective shield would then protect the skin by acting as a buffer between the stitches and the skin, and if made from suitable absorbent or wicking material, it also aids in absorbing the moisture from the forehead and transporting it to a region of the headgear where it may evaporate. Moreover, it may also act as a comfort padding on the forehead.

In view of the above, a motivation for this invention is to mitigate the disadvantages existing in the prior art by way of providing a headgear, including caps or hats, with enhanced moisture wicking and ventilation. This invention provides a suitable moisture wicking mechanism, and facilitates fast, easy evaporation of the moisture; a suitable design for the visor for enhanced absorption of the excess perspiration from the forehead; a wicking panel on the head that absorbs perspiration from the top of the head; a sweatband that comfortably secures the headgear to the head; a protective shield that protects the skin of the head from chafing due to embroidery or lapel pins; a sweat dome on top of the crown that absorbs the moisture from the top of the forehead and facilitates its evaporation from the top of the crown; and a visor insert that stays rigid and durable when subjected to repeated washing. These features may appear independently, or in any combination in any given embodiment of the headgear.

SUMMARY OF THE INVENTION

This invention is directed toward creating a headgear, including caps or hats, that has a suitable mechanism that absorbs and drains the moisture from the head, allows it to evaporate easily and efficiently, thereby leading to a cooling effect on the head.

This invention is designed to quickly channel perspiration from the head to areas away from the head for easy evaporation. In some embodiments, the soft portion of the visor of the cap has one or more sections in contact with the forehead. These soft sections have an enhanced absorption capacity to address the excess perspiration from the forehead area and provide increased comfort for the wearer of the headgear. In some embodiments, a second soft section is added onto the plastic portion of the visor. The second soft section is in physical contact with the first soft section, which in turn is in contact with the forehead. Thus, moisture is effectively drained from the forehead, and is wicked quickly to the second soft section through the first soft section. This moisture is then quickly evaporated through the first and second soft section. This allows the forehead to be continuously drained, and helps keep it dry. Moreover, the soft portion of the visor is not designed to retain the moisture, and this prevents the headgear from becoming heavy. Additionally, these soft sections may be attached to the crown at an angle so as to fit the forehead in a snugly.

In other embodiments, the crown has a sweat dome at the top, wherein moisture is absorbed from the top of the head and wicked to the exterior of the headgear through the sweat dome, where it evaporates easily.

In yet another embodiment, the reverse side of the headgear is fitted with a protective shield. This shield is generally placed behind a logo or badge or other such objects that may be attached to the outer surface of the headgear, so as to protect the skin from chafing due to friction from the stitches or pin on the reverse side of the embroidery or badge. The shield may be attached in a way so as to provide access to a recess between the shield and the inner portion of the crown, to facilitate stitching the embroidery, or pinning the badge or lapel, especially at any point in time after the hat is manufactured. The invention is also designed to provide added comfort to the head, especially to a bald human head. Another purpose of the invention is to add a suitable insert into the visor of a cap that allows the cap to be washed without loss of rigidity of the visor.

In particular, in some embodiments, this invention has a visor with a semi-rigid portion where it comes in contact with the wearer's forehead so that the contact is comfortable to the wearer. Moreover, the headgear employs a suitably comfortable inner lining with adjustable or integrated sweatbands and a soft visor. Both the visor and the sweatbands may house parts of the perspiration absorption mechanism.

In yet another embodiment of this invention, the visor comprises an insert of suitably light material so that it maintains its rigidity when subjected to stress and repeated machine washing.

In other embodiments, this invention provides a headgear, including caps or hats, with enhanced moisture wicking and ventilation. This invention provides a suitable moisture wicking mechanism, and facilitates fast, easy evaporation of the moisture; a suitable design for the visor for enhanced absorption of the excess perspiration from the forehead; a wicking panel on the head that absorbs perspiration from the top of the head; a sweatband that comfortably secures the headgear to the head; a protective shield, included during manufacture of the headgear, that allows for embroidery to be placed at any time after the headgear is manufactured, and that also protects the skin of the head from chafing due to embroidery or lapel pins; a sweat dome on top of the crown that absorbs the moisture from the top of the forehead and facilitates its evaporation from the top of the crown; and a visor insert that stays rigid and durable when subjected to repeated washing. These features may appear independently, or in any combination in any given embodiment of the headgear. It is generally preferable that the protective shield be relatively larger than the sweatband, so as to completely cover the forehead, adding a moisture-wicking, comfortable padding.

These and other features, variations and advantages which characterize this invention, will be apparent to those skilled in the art, from a reading of the following detailed description and a review of the associated drawings.

All features and advantages of this invention will be understood from the detailed descriptions provided. This description, however, is not meant to limit the embodiments, and merely serves the purpose of describing a preferred structural embodiment.

BRIEF DESCRIPTION OF THE DRAWINGS

A better understanding of the present invention will be had upon reference to the following description in conjunction with the accompanying drawings, wherein:

FIG. 1A shows a bottom perspective view of a crown and its interior space, illustrating the general orientation of the various parts of the crown;

FIG. 1B shows a bottom perspective view of a crown and its interior, with a wicking region on the inner portion;

FIG. 1C shows a bottom perspective view of a crown with a visor;

FIG. 1D shows a bottom perspective view of a crown with a visor that goes completely around the perimeter of the bottom of the crown;

FIG. 2A shows a top perspective view of a headgear comprising a crown and a visor, where the visor includes a soft, absorptive portion;

FIG. 2B shows a bottom perspective view of the headgear in FIG. 2A, with the crown turned out, and illustrating a wicking region;

FIG. 13A is a top perspective view, illustrating an embodiment where the visor has a soft portion;

FIG. 13B is a bottom perspective view showing the visor with two soft portions and a protective shield attached to the front.

DETAILED DESCRIPTION

While the invention will be described in connection with certain embodiments, there is no intent to limit it to these embodiments. On the contrary, the intent is to cover all alternatives, modifications and equivalents as included within the spirit and scope of the invention. Various changes may be made to the function and arrangement of the elements described herein, without changing the scope of the invention being disclosed. It should be noted that the following description serves to teach at least one instance of how the various elements may be arranged to achieve the stated goals of this invention.

Figure 1A:
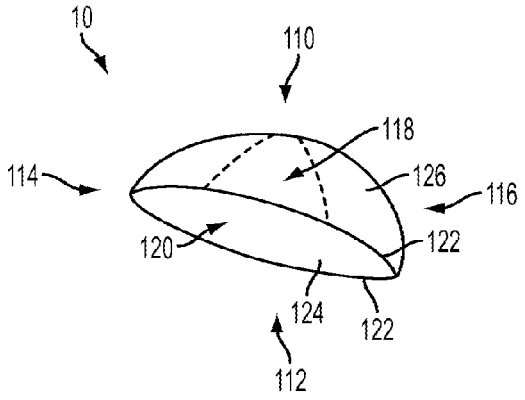
FIGS. 1A-D illustrate the different parts of some embodiments of this invention.

With reference to FIGS. 1A-D, different embodiments of a headgear are shown. FIG. 1A illustrates an embodiment of the headgear 10 comprising a crown. Headgear 10 comprises a top 110, a bottom 112, a front 114, a rear 116, and two sides, one of which is shown as 118. It has an outer surface 126, covering an inner portion 124. Additionally, the top, front, rear and two sides enclose an interior space 120, which is open at the bottom. The bottom 112 of the headgear has a perimeter 122. The above description, numbering, and orientation will henceforth apply to all the illustrations and descriptions that follow.

Figure 1B:
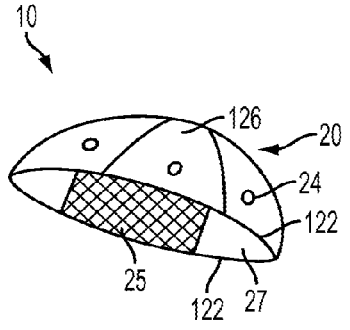

In FIG. 1B, another embodiment of a headgear 10 is shown. The crown 20 may have pores 24 that facilitate airflow between the interior space 120 and the exterior. The inner portion of the headgear 10 may comprise several layers of material. At least one of these layers, preferably the one closest to the head of the person wearing the headgear 10, may have several regions. Some of these regions may be made of wicking or other absorbent material. Such a wicking region or a network of channels 25 is shown, along with a non-wicking region 27. One or more layers of the inner portion may be removably attached to the crown 20.

Figure 1C:
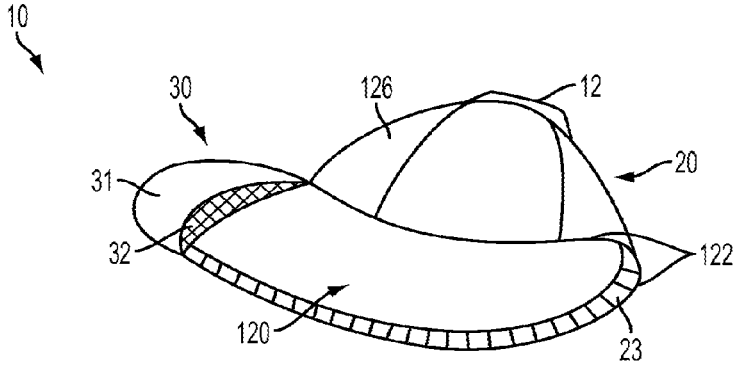

FIG. 1C shows another embodiment of a headgear 10. Here the headgear 10 comprises a crown 20 and a visor 30. Such an embodiment is typically found in baseball caps. The perimeter 122 and the interior space 120 are shown. The visor 30 is shown attached to the bottom of the crown 20, and projects away from the crown 20, extending horizontally at least partially around the perimeter 122 of the crown 20. The visor may comprise a firm portion 31 and one or more soft portions 32. Furthermore, this embodiment also has a sweat dome 12 which partially covers the top of the crown 20. The sweat dome 12 may additionally comprise a wicking element that extends into the inner portion 124. Such a wicking element 12*a* is depicted in FIG. 12B. Thus, dome 12 may also extend from the inner portion and project outward from the outer surface. The sweat dome 12 aids in the absorption of moisture from the top of a head. This is especially useful for a bald head. A sweatband 23 is shown attached to the inner portion, and extending, in this embodiment, fully around the perimeter 122. The sweatband 23 may only extend partially around the perimeter 122. The sweatband 23 collects the moisture that comes down from the sides of the head.

Figure 1D:
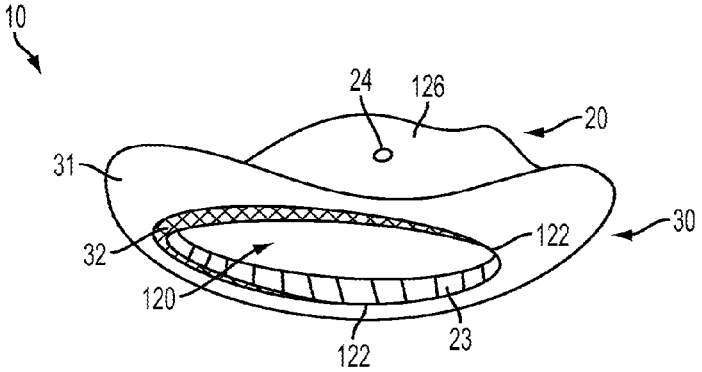

FIG. 1D shows another embodiment of a headgear 10. Here the headgear 10 comprises a crown 20 and a visor 30, where the visor extends horizontally fully around the perimeter 122 of the crown 20. Such an extended visor is also sometimes called the brim of a hat. Such an embodiment is typically found in hats. The visor may comprise a firm portion 31 and one or more soft portions 32. The perimeter 122 and the interior space 120 are shown. This embodiment of a headgear 10 may also have a sweat dome 12 to aid in the absorption of moisture from the top of a head. This is especially useful for a bald head. A sweatband 23 collects the moisture that comes down from the sides of the head. A pore 24 is also shown in this embodiment. This enhances the airflow between the interior 120 and the exterior, thereby enabling efficient evaporation and faster cooling.

Figure 2A:
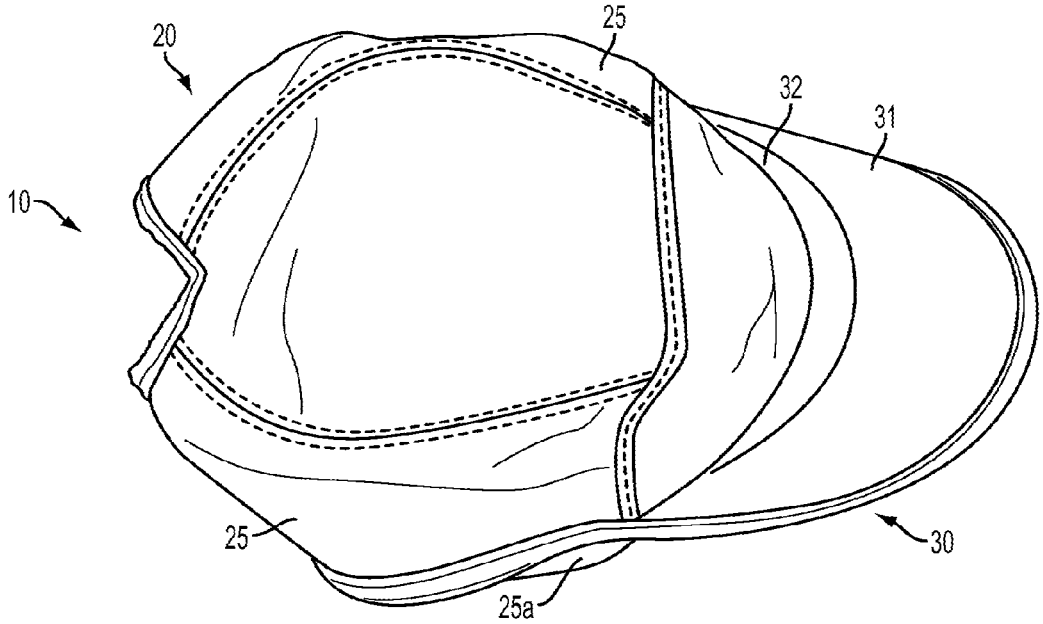
FIGS. 2A-B illustrate one embodiment of this invention.
Figure 2B:
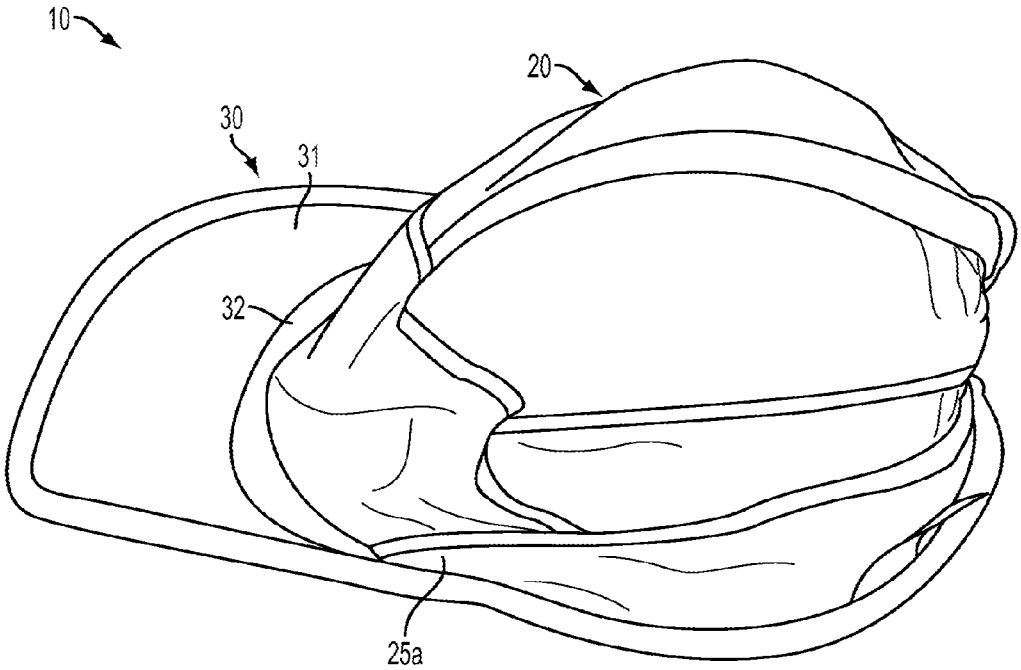

With reference to FIGS. 2A-2B, a headgear, including a protective headgear, cap or hat, may be worn for protection against the sun, or rain, or for comfort, as a clothing accessory, or to protect the head during athletic activities. A baseball or athletic cap is one of the embodiments, as shown at 10. The headgear 10 generally comprises a crown 20 and a visor 30. The visor 30 comprises a firm portion 31 and one or more soft portions 32. The placement of the soft portions 32 is toward the portion of the visor 30 that comes in contact with the forehead and is designed to enhance the absorption of the excess perspiration from the forehead, and to add comfort. Also shown here is a wicking region or network of channels 25, which is made of wicking or absorbing material.

FIG. 2B shows a bottom perspective view of the headgear 10 from FIG. 2A, with the crown turned out. It shows how the inner portion 124 of the crown 20 may comprise of several layers. In this case, layer 25*a* is made of absorbent or moisture wicking material. In this embodiment, the wicking region 25*a* is connected to the soft portions 32 on the visor 30. This allows the moisture to be absorbed from the head, drawn away from the crown 20, toward the visor 30, where it may evaporate or dissipate.

Figure 3:
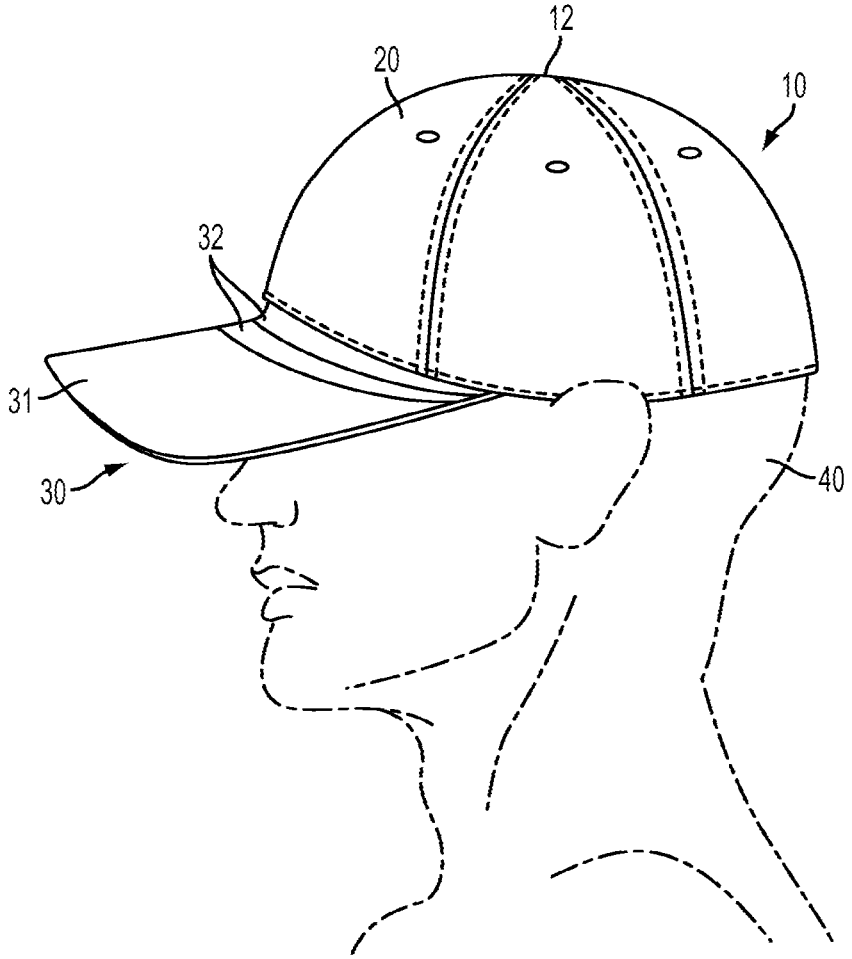
FIG. 3 shows another perspective view of an embodiment of the headgear placed on a bald head. Also shown is an embodiment of a wicking dome that is at the top of the crown, but not centrally placed thereon.

FIG. 3 shows another view of the headgear 10 sitting on a bald head 40 with the crown 20 completely enveloping the top of the bald head 40. The head is therefore inserted into the interior space 120 of the crown 20. A sweat dome 12 may be attached on top of the crown 20. In this embodiment, the sweat dome 12 is not visible since it is not located centrally near the top of the crown 20. Also, in some embodiments, the sweat dome 12 may have very little thickness. The sweat dome, when made of suitable wicking or other absorbing material, collects moisture from the top of the head, and transfers it to the outer surface of the crown 20.

This invention is designed to quickly channel perspiration from the head to areas away from the head for easy evaporation. In some embodiments, the visor 30 of the headgear 10 has one or more sections of the soft portion 32, in contact with the crown 20. These sections of the soft portion 32 have an enhanced absorption capacity to address the excess perspiration from the forehead area and provide increased comfort for the wearer of the headgear. In some embodiments, a second section of the soft portion 32 may be added onto the plastic portion of the visor. The second section of the soft portion 32 is in physical contact with the first section of the soft portion 32, which in turn is in contact with the forehead. Thus, moisture is effectively drained from the forehead, and is wicked quickly to the second section of the soft portion 32 through the first section of the soft portion 32. This moisture is then quickly evaporated through the first and second sections of the soft portion. This allows the forehead to stay dry. Moreover, the soft portion is not designed to retain the moisture, and this prevents the headgear from becoming heavy. Additional sections, when added to the soft portion, will enhance the moisture wicking process still further.

Figure 4:
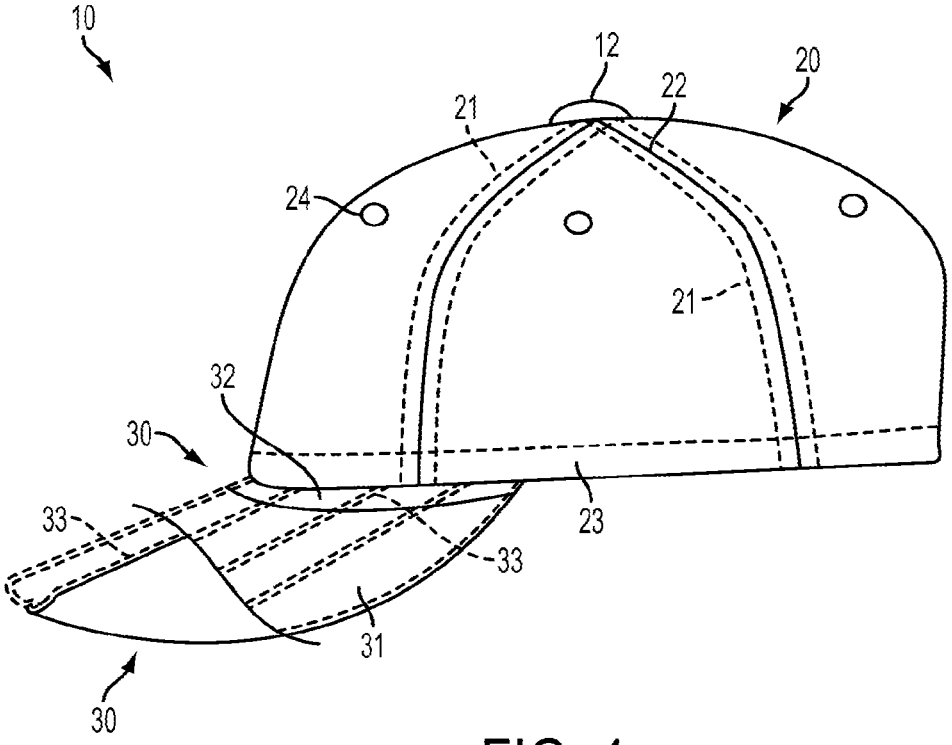
FIG. 4 illustrates one embodiment of the wicking regions, or network of channels, to absorb moisture.

FIG. 4 illustrates an embodiment of a moisture wicking mechanism. In this embodiment, the crown 20 comprises a wicking region or network of channels 21 made of commercially available light-weight wicking material. The Figure illustrates one possible positioning of the wicking region, or channel, 21 along the seams 22 sewn into the crown 20. The wicking material absorbs the moisture from the head using a capillary action. This network preferably passes through the sweatband 23. The wicking regions, or channels, 21 are connected to the wicking regions, or channels, 33 located on the visor 30. The wicking regions, or channels, 33 are also made up of suitable lightweight wicking material, and may be designed so that the capillaries are somewhat wider than the capillaries in the wicking regions, or channel, 21. The wicking regions, or channels, 33 may pass through both the absorbent soft portion 32 and the firm portion 31 of the visor 30. The Figure also illustrates how small pores 24 may be included in the crown 20 for added airflow. In some embodiments, we may also add a sweat dome 12 which aids in the absorption of moisture from the top of a head. This is especially useful for a bald head.

Figure 5:
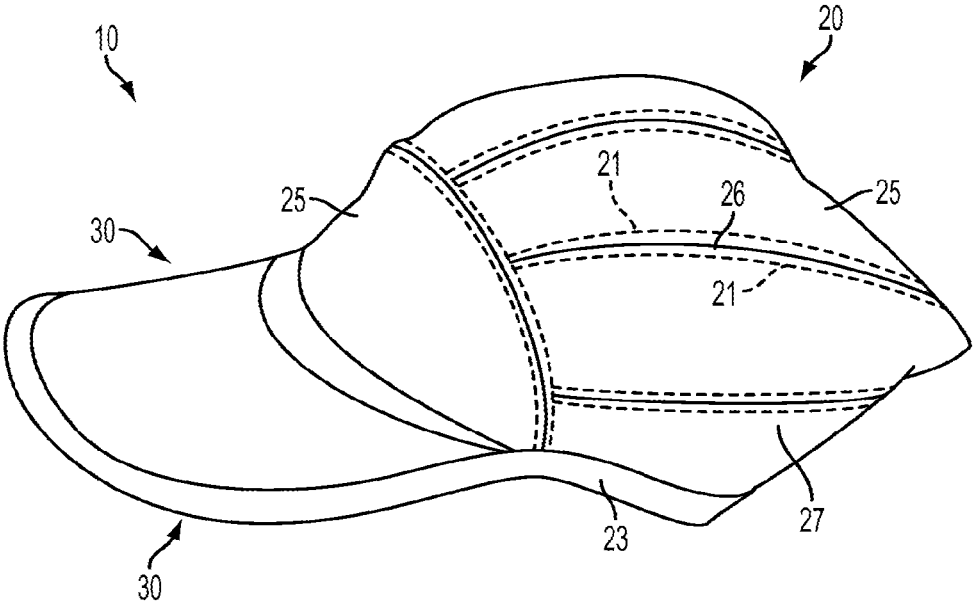
FIG. 5 shows one embodiment with two wicking regions.

FIG. 5 illustrates another embodiment 10 of this invention. The Figure depicts two wicking regions, or channels, 25 on the crown 20. Here one is centrally located and runs longitudinally along the top of the crown 20 from the front side of the crown 20 to the rear. The other wicking region, or channel, 25 runs across the front of the crown 20. At the front of the crown 20, the wicking region, or channel, 25 is attached to the soft absorbent portion 32 of the visor 30. The inner portion of the wicking regions, or channels, 25 may comprise multiple thin layers of commercially available lightweight wicking material. The layer that comes in contact with the head, absorbs the moisture, and transfers it to the layer above it so as to let the moisture evaporate. The seams 26 of the wicking region, or channel, 25 may also be made of wicking material and be connected to the wicking region, or channel, 21 that run along the crown 20. The wicking region, or channel, 25 are connected to the wicking region, or channel, 33 located on the visor 30 so that the perspiration may be directed away from the head. Additionally, FIG. 5 illustrates side panels 27 that run longitudinally along either side of the wicking region, or channel, 25. In this embodiment, the side panels 27 are shown connected to the sweatband 23. In some embodiments, the side panels 27 may be made of commercially available appropriate soft netting material to aid air flow. The wicking region, or channel, 21 may run along the side panels 27.

Figure 6:
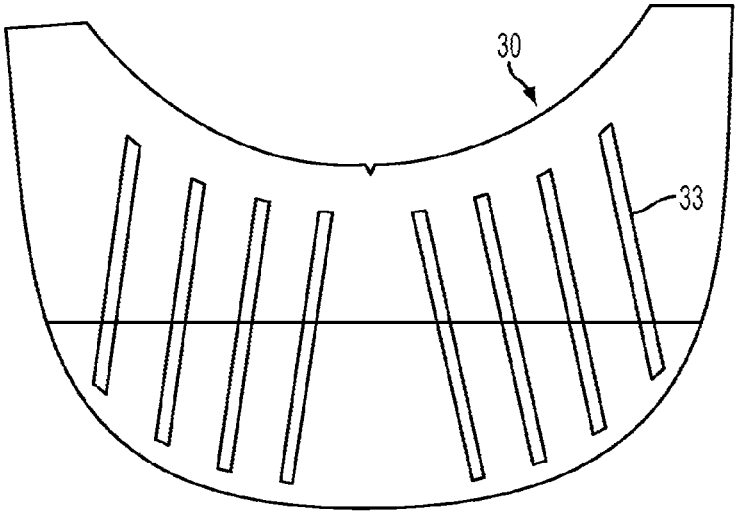
FIG. 6 shows one embodiment of the visor with the wicking regions, or network of channels.
Figure 7:
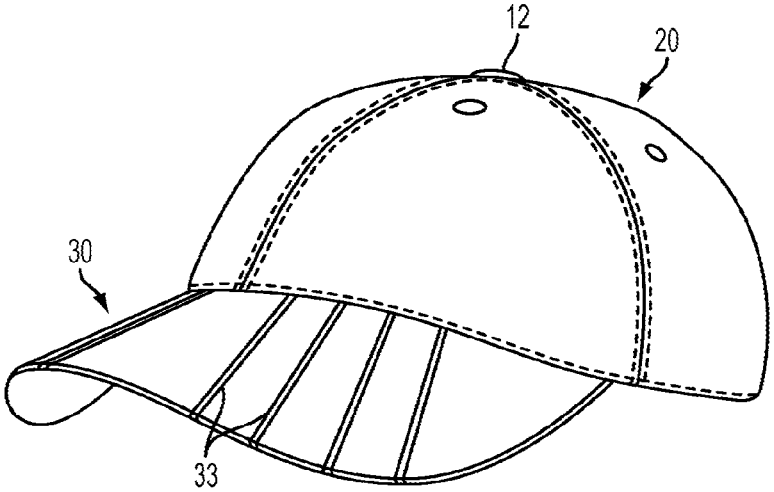
FIG. 7 shows one embodiment of the visor with the wicking regions, or network of channels in relation to the crown.

It is likely that subsequent to heavy perspiration, the capillaries in the wicking material that constitute the wicking regions, or network of channels, 21 and 33 get filled and do not allow for the absorption of any more moisture. To avoid this eventuality, the visor 30 may be adequately ventilated. This ventilation will aid in quick evaporation, thus freeing up the wicking regions, or network of channels, 33 which will then draw out the moisture from the wicking regions, or network of channels, 21. This will allow the wicking regions, or network of channels, 21 to draw up more moisture from the head. In addition to keeping the head dry, the evaporation will also cause a cooling effect. FIG. 6 shows how the wicking regions, or network of channels, 33 may be placed in the visor 30. FIG. 7 shows the placement of the wicking regions, or network of channels, 33 in relation to the position of the crown 20. A sweat dome 12 may or may not be included in such embodiments.

Figure 8:
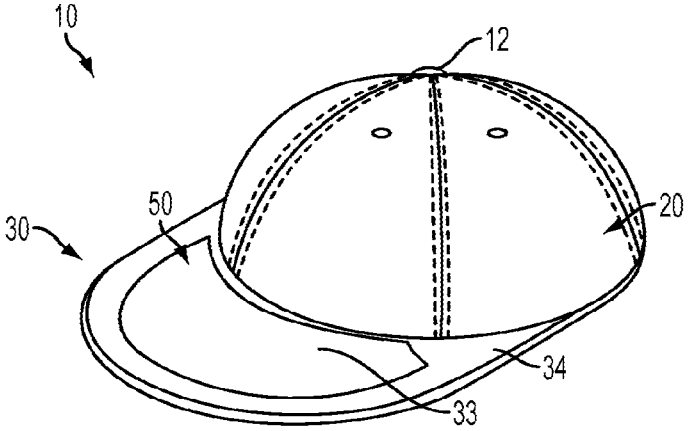
FIG. 8 illustrates the ventilating mechanism in the visor.

FIG. 8 illustrates a suitable ventilation mechanism 50 for the visor 30. As the wicking region, or network of channels, 33 draws out the moisture onto the visor 30, the moisture is brought out to the outer surface 34 of the visor 30. Here the flow of air through the visor causes moisture to evaporate rapidly.

Figure 9:
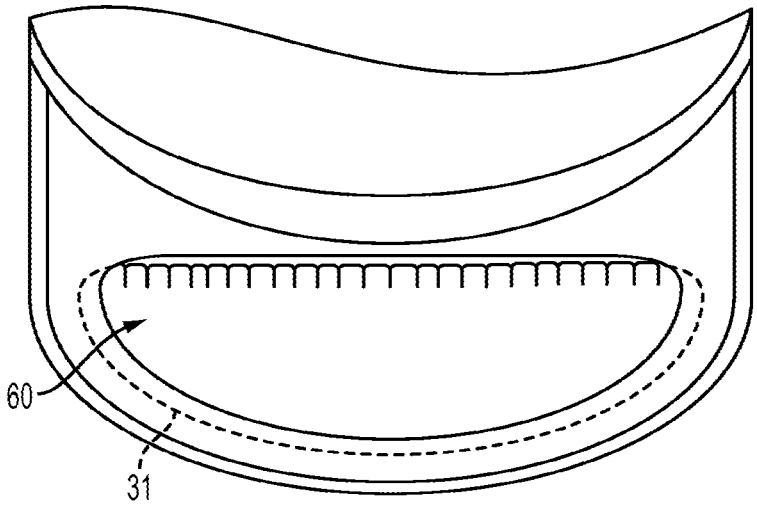
FIG. 9 shows one embodiment of the visor insert.

Another objective of the invention is to provide a visor with an insert that is both durable and maintains its rigidity subsequent to repeated washing. FIG. 9 illustrates how such an insert 60 is placed inside the firm portion 31 of the visor 30. The insert 60 may be made of commercially available material such as durable plastic material, as used in inserts for maintaining rigid tie-collars for shirts. This allows for lightweight construction and washability. In some embodiments, the insert may itself be of wicking or absorbent material, thereby enhancing the moisture wicking capabilities of the headgear, and also aiding in faster evaporation of the moisture from the outer surface 34 of the visor 30.

Figure 10:
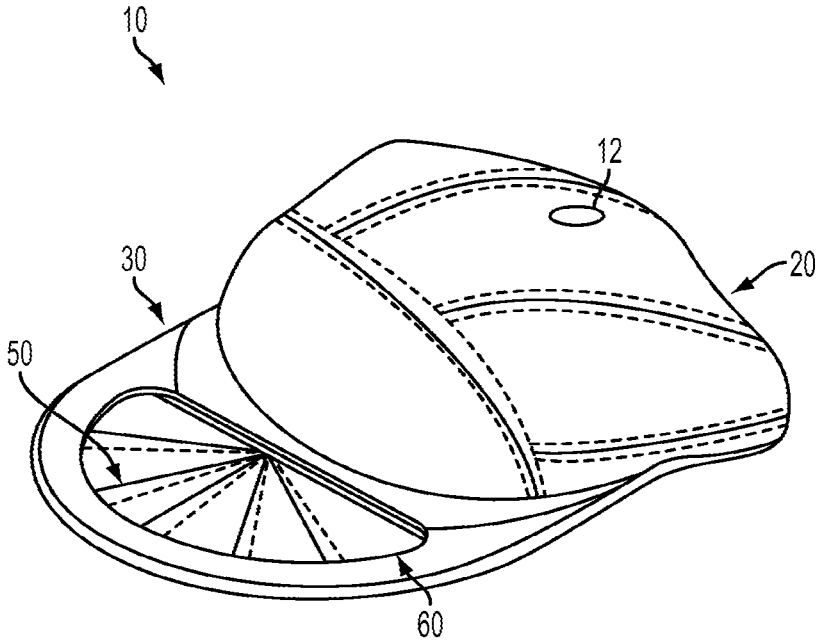
FIG. 10 shows one embodiment of the visor insert in tandem with the moisture wicking mechanism.

FIG. 10 illustrates how the visor insert 60 may be placed in tandem with the ventilation mechanism 50.

Figure 11:
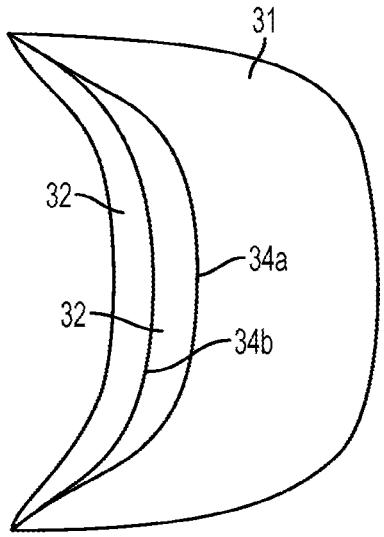
FIG. 11 shows two absorbent soft portions, and the firm portion of the visor.
Figure 11:
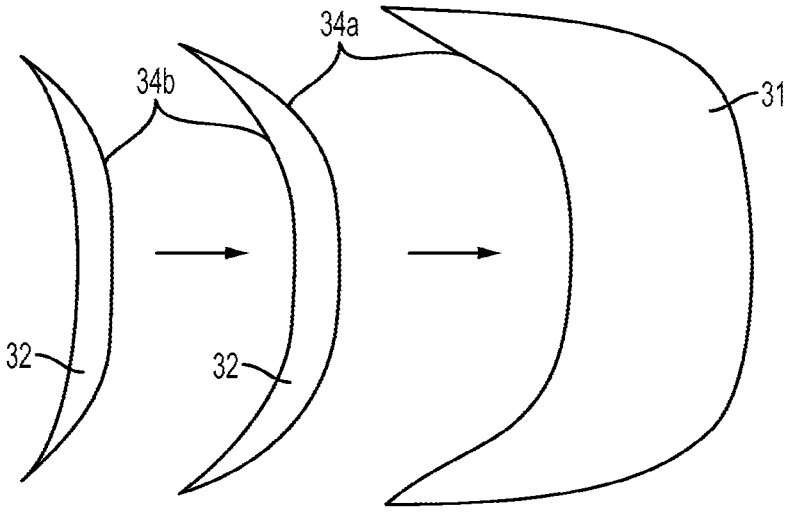

A further objective of the objective of the invention is to provide a layer of extra absorbent soft padding, especially for the comfort of a bald person wearing the cap. FIG. 11 shows how the soft portions 32 of the visor 30 may be attached, for example, by sewing onto the firm portion 31. The soft portion 32 may be manufactured as a padding using commercially available lightweight, soft and moisture wicking material. The soft absorbent portion 32 may be sewn to the firm portion 31 in such a way as to allow for a slight relative angle along their curve of contact 34*a*. Similarly, in those embodiments that have more than one soft portion 32, the second soft portion may be attached to the first soft portion along a curve of contact 34*b*. The attachment along 34*b* may also be effected at a slight angle. The direction of these angles is such that when the headgear is placed on the head, the soft portion 32 fits snugly on the forehead so as to enhance absorption of the excess perspiration and provide adequate padding to the forehead. The manner in which such angles may be chosen accomplished this end will be apparent to those of ordinary skill in the art.

It is common for headgears to be manufactured in bulk. Many of these headgears have logos embroidered on them. When embroidered caps are produced en masse, it is commercially viable to include the embroidery step as a part of the manufacturing process. In such instances, the headgear may come fitted with a flap that helps acts as a buffer between the embroidery stitches and the skin of the wearer of the headgear. Oftentimes though, when headgears are manufactured in bulk, they come without any embroidery or other designs. Typically, businesses or individuals approach retailers who carry these generic headgears, and require the headgears to be appropriately personalized. In particular, businesses or individuals may require a logo or some other embroidery to be placed onto the outer surface of the headgear, after the headgear has been manufactured. Many golf caps, for instance, are personalized after they are manufactured. When such a logo or embroidery is stitched onto the headgear, the stitches appear on the reverse side of the headgear. Given the costs of attaching an extra flap to buffer the stitches from the skin, most retailers skip this step.

The presence of the stitches on the reverse side of the embroidery may cause the skin to be irritated when it comes in contact with the stitches. This is especially true if the head lacks hair to act as a protective buffer. Thus, bald men would be more sensitive to chafing of the skin due to continuous friction between the skin and the stitches. This may be further exacerbated under hot or humid conditions. There is therefore a need for a protective shield to be placed at the time of manufacture of the headgear, without the headgear being personalized. Such a protective shield must be designed and placed in such a way so that embroidery may be added at any time after the manufacturing process is complete, and at any point in the stream of commerce. Moreover, if, as and when a logo is embroidered, the shield may then act as a protective buffer between the skin and the embroidery, without any additional modifications to the headgear. Therefore, this shield would be required to provide access to the region of the stitches so that an embroidery hoop or other such device may be inserted to embroider the selected portion of the headgear. Such a protective shield would then protect the skin by acting as a buffer between the stitches and the skin, and if made from suitable absorbent or wicking material, it also aids in absorbing the moisture from the forehead and transporting it to a region of the headgear where it may evaporate. Moreover, it may also act as a comfort padding on the forehead.

Figure 12A:
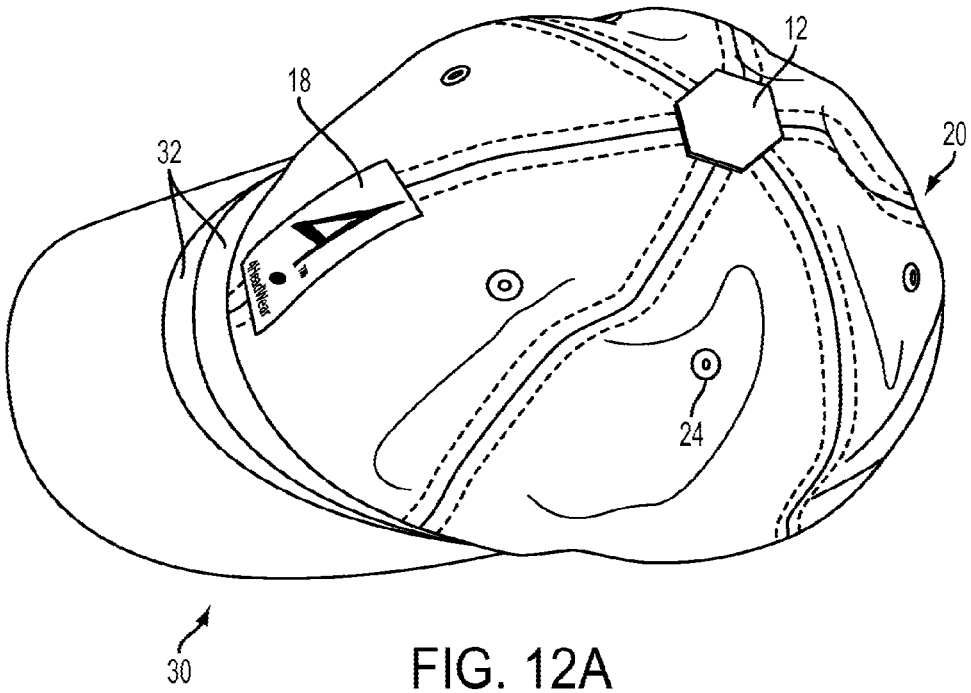
FIG. 12A shows a top perspective view of one embodiment of a headgear, with an embroidered logo on the front.
Figure 12B:
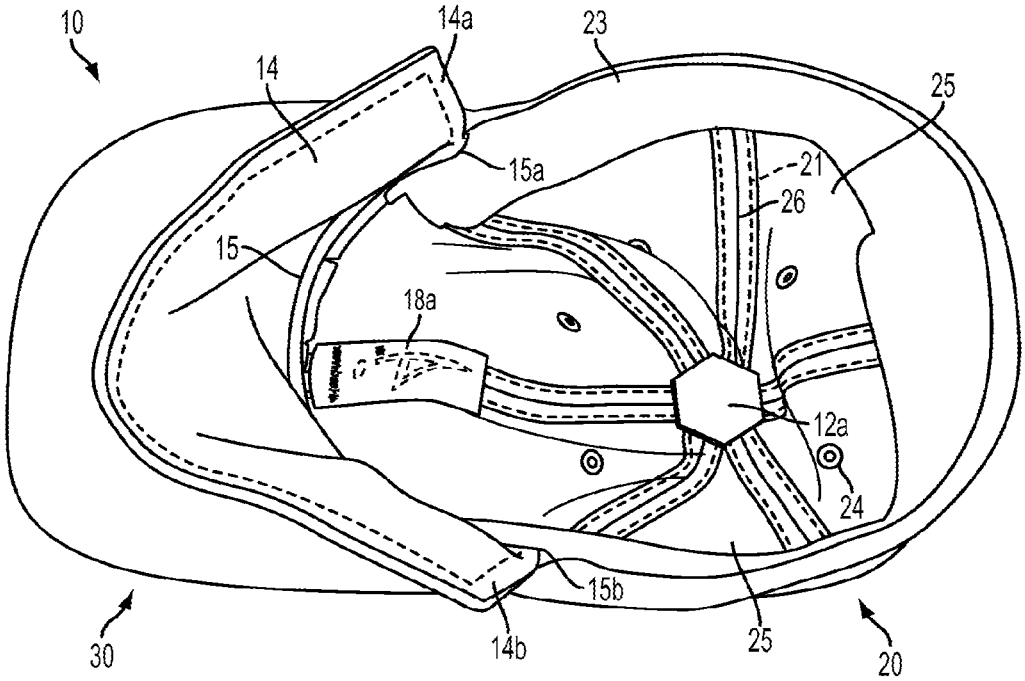
FIG. 12B shows a bottom perspective view of the headgear of FIG. 12A, illustrating the protective shield which is included at the time of manufacture of the headgear, with one edge of the shield contoured to attach to the perimeter of the crown, at the front.

FIGS. 12A-B illustrate how this need may be met. FIG. 12A illustrates an embroidered logo 18 sewn onto the crown 20 toward the front. This embroidered portion could appear anywhere on the crown. A wicking dome 12 is also shown, as are two soft portions 32 on the visor 30.

Figure 12C:
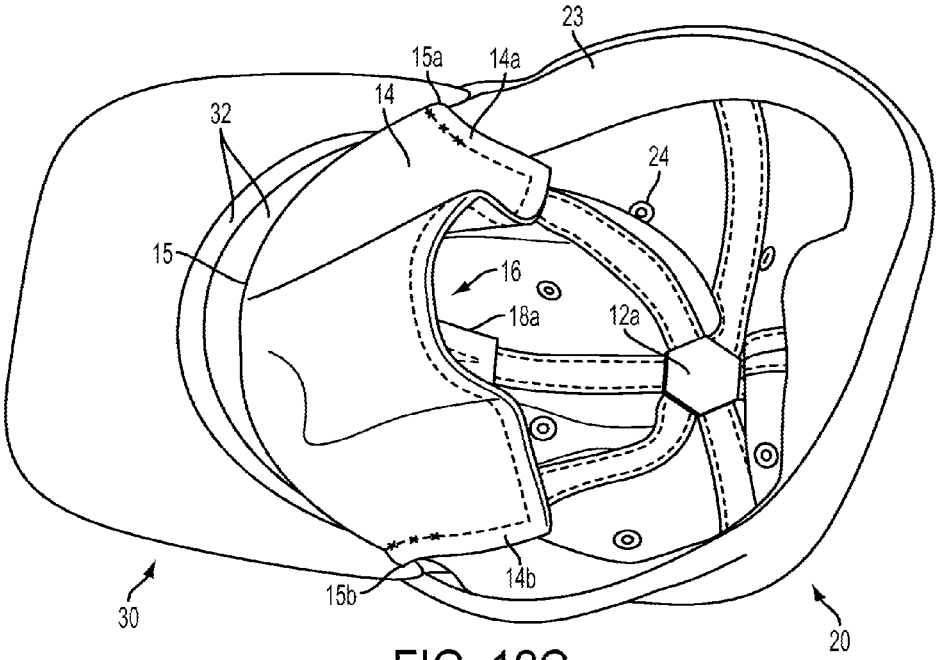
FIG. 12C shows a bottom perspective view of the headgear of FIG. 12A, illustrating how the second and third edges of the protective shield may be partially attached to the inner portion of the crown, providing an access to the recess between the inner portion and the protective shield.

FIG. 12B shows the reverse side of the headgear 10 from FIG. 12A. The reverse side 18*a* of the embroidered logo 18 is shown on the inner portion. This figure illustrates an embodiment of the protective shield 14. Here the protective shield 14 is also placed toward the front of the crown. In general, its placement would depend on the placement of the embroidery or lapel pin. Generally, it is preferred that the shield 14 be placed on the inside portion of the crown to cover the reverse portion of the embroidery or pin or badge. The first edge 15 of this shield is shown contoured to attach to the perimeter 122 of said crown 20. The second and third edges of the shield, shown here as the two shorter sides 14*a* and 14*b*, are not attached in this embodiment. The second edge 14*a* is shown extending from the first end 15*a* of the first edge 15, and the third edge 14*b* is shown extending from the second end 15*b* of the first edge 15. Also shown is the reverse side of the dome with a wicking element, 12*a*. Pores, such as 24, may also be present on the crown 20. Two wicking regions, or network of channels, are shown in 25. In this embodiment, the seams 21 of the wicking regions may additionally comprise wicking regions, or network of wicking channels, 26. Such a wicking region, or network of channels, 26, may not be present in all embodiments, as illustrated in FIG. 12C. Also shown in this embodiment is a sweatband 23 that runs around the entire perimeter of the crown 20. In this embodiment, the sweatband 23, the wicking region 25 and the wicking element 12*a* of the dome 12, are all connected to each other, thereby allowing moisture to be absorbed and transferred to the dome 12, or the visor 30, for efficient evaporation.

FIG. 12C is another view of the reverse side of the headgear 10 from FIG. 12A. The second and third edges 14*a* and 14*b* of the protective shield 14 are now shown to be partially attached to the inner portion of the crown 20. The reverse side of the embroidered logo, 18*a*, is now almost hidden by the shield 14. Also shown is a small recess 16 created by the second edge 14*a* and the third edge 14*b* of the shield 14. The recess 16 is between the shield 14 and the inner portion 124 of the crown 20. Such a recess may be used to insert or attach items such as, but not limited to, a lapel, a lapel pin, a badge, or an embroidery hoop, or needle, to embroider. Such a recess 16 provides additional airflow through the interior 120 of the crown 20.

The significance of such a recess 16 is that a headgear can be manufactured with this recess. Later, at any point of time after the manufacture of the headgear 10, such a recess 16 may be used to insert or attach items such as, but not limited to, a lapel, a lapel pin, a badge, or an embroidery hoop, or needle, to embroider. Moreover, after such embroidery 18 has been placed, the recess 16 may be closed. In many instances, it is not commercially viable to close the recess. In such instances, the shield 14 may be flattened to lie smoothly against the inner portion 124 of the crown 20.

The shield 14 protects the skin of the person wearing the headgear, from chafing by an object attached to the outer surface of the crown 20, and protruding to the inner portion 124. This embodiment also shows the sweatband 23, the soft portions 32, and the protective shield 14 to be connected. When the shield 14 is also made of wicking material, it helps absorb moisture from the head. When connected to the soft portion 32, the shield 14 transfers moisture to the soft portion 32, and therefore away from the crown 20. In embodiments that also have wicking regions, or a network of channels, or a wicking insert in the firm portion 31 of the visor 30, this moisture may be transferred even further away from the crown 20.

Figure 12D:
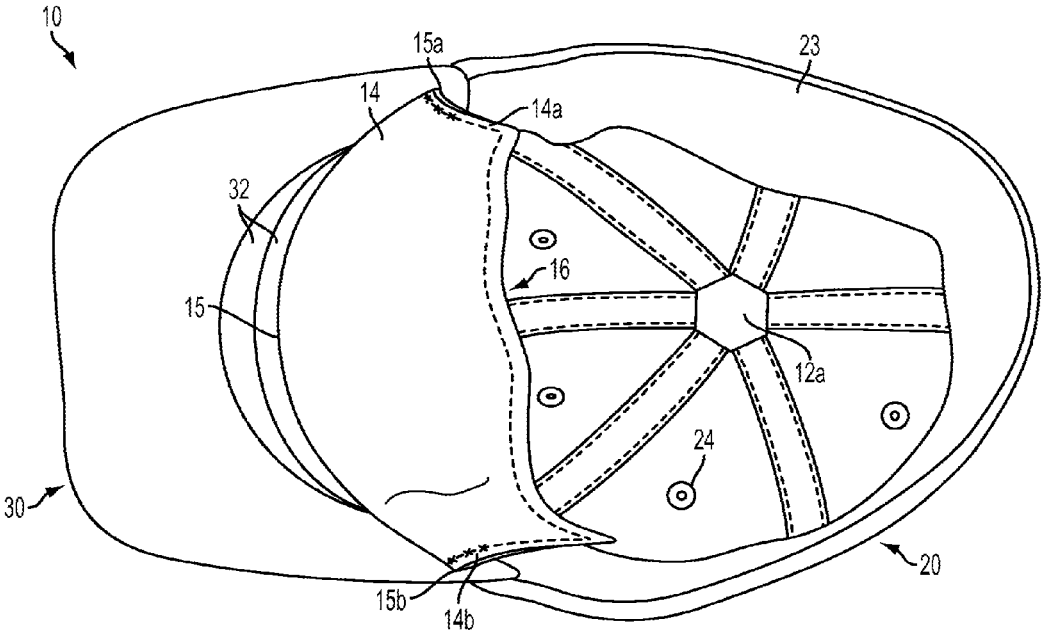
FIG. 12D shows a bottom perspective view of the headgear of FIG. 12A, illustrating how the protective shield may lay flat, smooth and pressed in, against the inner portion, and protect the skin of the wearer from chafing.

In FIG. 12D we see another view of the reverse side of the headgear 10 from FIG. 12A. Here the shield 14 is shown to lie flat against the inner portion. It is smooth and pressed so that the headgear may be worn comfortably. As can be seen from the figure, the reverse portion 18*a* of the embroidery 18 is no longer visible. The shield therefore protects the skin from chafing due to the friction from the stitches on the reverse side of embroidery, or from the pin of a lapel, badge etc. The recess 16 between the shield 14 and the inner portion 124 of the crown 20 is now closed. The edges 14*a* and 14*b* of the shield 14 may be attached to the inner portion 124 after the embroidery is placed. When unattached, the shield 14 allows some airflow through the shield 14 and the inner portion 124, thereby causing an additional cooling effect.

In most circumstances, it will be desirable to make the protective shield 14 that is described in FIGS. 12A-D, to be of a larger size than the sweatband 23. In particular, the shield 14 should certainly be large enough to cover the reverse stitching 18*a* of embroidery; but it could also be much larger so as to substantially cover the inner portion 124 of the crown 20. In the embodiments where the embroidery is placed at the front of the headgear, the protective shield 14 may also act as a soft padding on the forehead, with additional moisture wicking capabilities. In such cases, the shield 14 could be large enough to cover the entire forehead. Since the process of inserting embroidery may typically be performed at some time after the headwear is manufactured, it is not desirable for the shield 14 to cover the entire inner portion, since this would restrict access to the recess 16, thus interfering with the process of embroidery.

Figure 13A:
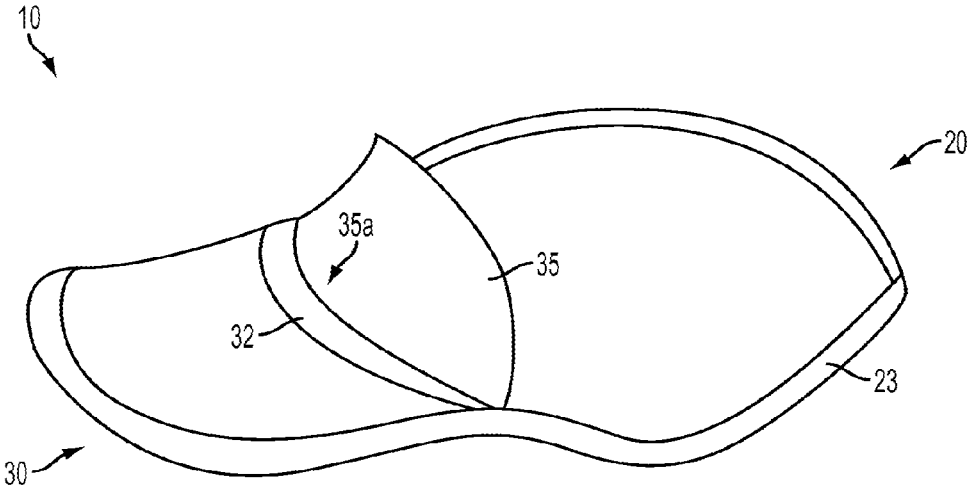
FIGS. 13A-B show an embodiment of a headgear of this invention comprising a front, a visor and a band.
Figure 13B:
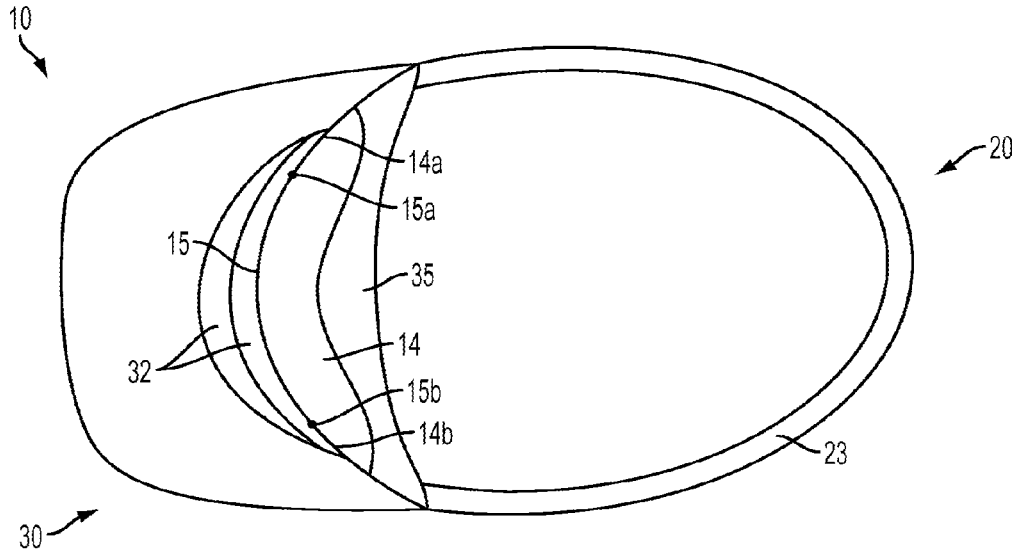

In FIGS. 13A and 13B, we illustrate embodiments of the headgear 10 comprising a front panel 35, a visor 30 and a band 23. This embodiment essentially comprises the previous embodiments described, wherein the top and the sides of the crown 20 have been removed. Such embodiments are typically found in tennis caps. FIG. 13A is a top perspective view showing the visor 30 with a soft portion 32. The soft portion 32 is shown attached to the front panel 35 at the bottom 35*a* of the front panel 35. The band 23 could be a headband, but it could also be a sweatband, made of appropriate wicking or other absorbent material. The band 23 is connected to the front panel 35 near the bottom 35*a* of the front panel 35. It is shown to extend out so as to encircle the head of the wearer of the headgear 10.

FIG. 13B is a bottom perspective view of headgear 10. It shows the reverse side of the front panel 35, the visor 30 with two soft portions 32, and a headband or sweatband 23. Also shown in this embodiment is a protective shield 14 with a first edge 15 contoured to attach to the inner portion of said front panel 35 near its bottom 35*a*. The second edge 14*a* is connected to the first edge 15 at the first end 15*a* of the first edge 15. The third edge 14*b* is connected to the first edge 15 at the second end 15*b* of the first edge 15. The second and third edges 14*a* and 14*b* of the protective shield 14 are shown to be partially attached to the reverse portion of the front panel 35. Also shown is a small recess 16 created by the second edge 14*a* and the third edge 14*b* of the shield 14. The recess 16 is between the shield 14 and the reverse portion of the front panel 35. Just as described in the illustrations and detailed description of FIGS. 12A-D, such a recess may be used to insert or attach items onto the front panel 35, such as, but not limited to, a lapel, a lapel pin, a badge, or an embroidery hoop, or needle, to embroider. Such a recess 16 provides additional airflow through the front panel 35. The shield 14 protects the skin of the person wearing the headgear, from chafing by an object attached to the front panel 35, and protruding to the reverse portion of the front panel 35. As shown in FIG. 13A, the protective shield 14 conforms to the shape of the front panel 35 and cannot be seen. When the shield 14 is also made of wicking material, it helps absorb moisture from the head. When connected to the soft portion 32, the shield 14 transfers moisture to the soft portion 32 and therefore away from the front panel 35 and the forehead. In FIG. 13B, the shield 14 is shown to lie flat against the reverse portion of the front panel 35. It is smooth and pressed so that the headgear may be worn. Although not shown in the figure, the description of FIGS. 12A-D will enable a person of ordinary skill to understand that the reverse portion 18*a* of embroidery 18 or a pin would no longer visible.

The significance of such a recess 16 is that a headgear can be manufactured with this recess. Later, at any point of time after the manufacture of the headgear 10, such a recess 16 may be used to insert or attach items such as, but not limited to, a lapel, a lapel pin, a badge, or an embroidery hoop, or needle, to embroider. Moreover, after such embroidery 18 has been placed, the recess 16 may be closed. In many instances, it is not commercially viable to close the recess. In such instances, the shield 14 may be flattened to lie smoothly against the inner portion of the front panel 35.

In most circumstances, it will be desirable to make the protective shield 14 that is described in FIGS. 13A-B, to be of a larger size than the sweatband or band 23. In particular, the shield 14 should certainly be large enough to cover the reverse stitching 18*a* of embroidery; but it could also be much larger so as to substantially cover the inner portion of the front panel 35. In the embodiments where the embroidery is placed at the front of the headgear, the protective shield 14 may also act as a soft padding on the forehead, with additional moisture wicking capabilities. In such cases, the shield 14 could be large enough to cover the entire forehead. Since the process of inserting embroidery may typically be performed at some time after the headwear is manufactured, it is not desirable for the shield 14 to cover the entire inner portion, since this would restrict access to the recess 16, thus interfering with the process of embroidery.

In various embodiments, what is described is a headgear, including caps or hats, with enhanced moisture wicking and ventilation. This invention provides a suitable moisture wicking mechanism, and facilitates fast, easy evaporation of the moisture; a suitable design for the visor for enhanced absorption of the excess perspiration from the forehead; a wicking panel on the head that absorbs perspiration from the top of the head; a sweatband that comfortably secures the headgear to the head; a protective shield that protects the skin of the head from chafing due to embroidery or lapel pins; a sweat dome on top of the crown that absorbs the moisture from the top of the forehead and facilitates its evaporation from the top of the crown; and a visor insert that stays rigid and durable when subjected to repeated washing. These features may appear independently, or in any combination in any given embodiment of the headgear.

While many novel features have been described above, the invention is not limited to these physical embodiments. It is described and illustrated with particularity so that that those skilled in the art may understand all other embodiments that may arise due to modifications, changes in the placement of the relative components, omissions and substitutions of this preferred embodiment that are still nonetheless within the scope of this invention.

What is claimed is:

1. A headgear comprising:
a crown;
the crown comprising a top, a bottom, a front, a rear, and two sides;
the front and the rear being oriented opposite to each other;
each side extending from the front to the rear;
the top, front, rear and two sides enclose an interior space, open at the bottom;
the bottom comprising a perimeter;
the crown further comprising an outer surface and an inner surface;
the inner surface facing the interior space;
the crown comprising multiple sections joined at seams, the seams forming a convergence at the top of the crown; and
a dome comprised of wicking material;
the dome at least partially covering an exterior surface at the top of the crown, and having a wicking element comprised of wicking material that extends through the convergence of seams at the top of the crown into the interior space of the crown.

2. The headgear of claim 1, wherein the crown further comprises one or more crown wicking channels disposed on the inner surface, the one or more crown wicking channels comprised of wicking material and configured to use capillary action to absorb moisture from the head.

3. The headgear of claim 2, wherein the one or more crown wicking channels are connected to the dome.

4. The headgear of claim 2, further comprising a sweatband attached to the inner surface and extending at least partially around the perimeter of the crown, the sweatband being a strip of wicking material.

5. The headgear of claim 4, wherein the one or more crown wicking channels are connected to the sweatband.

6. The headgear of claim 2, wherein the one or more crown wicking channels are disposed on the inner surface of the crown along one or more of the seams.

7. The headgear of claim 2, wherein the one or more crown wicking channels comprise a network of crown wicking channels disposed on the inner surface of the crown along the seams.

8. The headgear of claim 2, further comprising a visor having a contoured edge attached to the bottom of the crown.

9. The headgear of claim 8, further comprising one or more visor wicking channels disposed on the visor.

10. The headgear of claim 9, wherein the one or more crown wicking channels are connected to the one or more visor wicking channels.

11. A headgear comprising:
a crown;
the crown comprising a top, a bottom, a front, a rear, and two sides;
the front and the rear being oriented opposite to each other;
each side extending from the front to the rear;
the top, front, rear and two sides enclose an interior space, open at the bottom;
the bottom comprising a perimeter;
the crown further comprising an outer surface and an inner surface;
the inner surface facing the interior space;
the crown comprising multiple sections joined at seams, the seams forming a convergence at the top of the crown; and
one or more crown wicking channels disposed on the inner surface, the one or more crown wicking channels comprised of wicking material exposed to the interior space and configured to use capillary action to absorb moisture directly from the head.

12. The headgear of claim 11, wherein the one or more crown wicking channels are disposed on the inner surface of the crown along one or more of the seams.

13. The headgear of claim 12, wherein the one or more crown wicking channels comprise a network of crown wicking channels disposed on the inner surface of the crown along the seams.

14. The headgear of claim 11, further comprising a dome comprised of wicking material, the dome at least partially covering the top of the crown, and having a wicking element comprised of wicking material that extends through the convergence of seams into the interior space of the crown;
wherein the one or more crown wicking channels are connected to the dome.

15. The headgear of claim 14, further comprising a sweatband attached to the inner surface and extending at least partially around the perimeter of the crown, the sweatband being a strip of wicking material.

16. The headgear of claim 15, wherein the one or more crown wicking channels are connected to the sweatband.

17. The headgear of claim 16, further comprising:
a visor having a contoured edge attached to the bottom of the crown; and
one or more visor wicking channels disposed on the visor.

18. The headgear of claim 17, wherein the one or more crown wicking channels are directly connected to the one or more visor wicking channels.

19. The headgear of claim 17, wherein the one or more crown wicking channels are indirectly connected to the one or more visor wicking channels via the sweatband.

20. A headgear comprising:
a crown;
the crown comprising a top, a bottom, a front, a rear, and two sides;

the front and the rear being oriented opposite to each other;

each side extending from the front to the rear;

the top, front, rear and two sides enclose an interior space, open at the bottom;

the bottom comprising a perimeter;

the crown further comprising an outer surface and an inner surface;

the inner surface facing the interior space; and a dome comprised of wicking material;

the dome including an exposed portion that at least partially covers an exterior surface at the top of the crown and is exposed to air, and having a wicking element comprised of wicking material that extends through the crown into the interior space of the crown.

* * * * *